US005381220A

United States Patent [19]

Acquaviva et al.

[11] Patent Number: 5,381,220

[45] Date of Patent: Jan. 10, 1995

[54] SHEET HANDLING SYSTEM FOR PLURAL CYCLE PRINTING MACHINES

[75] Inventors: Thomas Acquaviva, Penfield; Cyril G. Edmunds, Webster, both of N.Y.

[73] Assignee: Xerox Corporation, Stamford, Conn.

[21] Appl. No.: 55,885

[22] Filed: May 4, 1993

[51] Int. Cl.[6] ..... G03G 21/00

[52] U.S. Cl. ..... 355/308; 355/316; 355/319; 355/323

[58] Field of Search ..... 355/308, 316, 318, 319, 355/323

[56] References Cited

U.S. PATENT DOCUMENTS

| | | | |
|---|---|---|---|
| 4,941,023 | 7/1990 | Holmes et al. | 355/319 |
| 4,949,949 | 8/1990 | Holmes et al. | 271/3 |
| 4,990,965 | 2/1991 | Kiyo | 355/319 |
| 5,012,296 | 4/1991 | Dimissen et al. | 355/320 |
| 5,095,342 | 3/1992 | Farrell et al. | 355/319 |
| 5,296,908 | 3/1994 | Hatano et al. | 355/319 |

*Primary Examiner*—Fred L. Braun

[57] ABSTRACT

A sheet transport system for automatically transporting sheets is provided. The system includes a primary path apparatus for feeding printed sheet images there, along a printing station to imprint sheets. The sheet transport system also provides an apparatus for transporting selected ones of the sheets along the path to a sheet path portion remote from the primary path and for returning selected ones of the sheets to the other fed sheets so that the combined sheets are arranged in a collated manner corresponding to the predetermined sequence. The system also includes, in the secondary or shunt path, a buffer for holding sheets previously passing through the printing station. The secondary path is arranged to permit selected return of ones of the sheets in the shunt path to the primary path. The system may also include a path for returning printed sheets in the primary path to the printing station. Thus, the sheet handling system provides for selective reordering of imaged sheets to promote improved printing operations.

2 Claims, 2 Drawing Sheets

SHEET HANDLING SYSTEM FOR PLURAL CYCLE PRINTING MACHINES

BACKGROUND OF THE INVENTION

This invention relates generally to a sheet handling system for transporting sheets to and from a transfer station and, more particularly, concerns a sheet handling system for transporting copy sheets to and from a transfer station for out-of-sequence imaging and later integration to form a stream of imaged copy sheets in a predetermined collated order.

U.S. Pat. No. 5,095,342, issued to Farrell et al., assigned to the Xerox Corporation and issued on Mar. 10, 1992, is hereby incorporated herein by reference thereto.

Sheet transports are well known, and, generally, have a defined path through which sheet material is transported to and from one or more process stations. In electrophotographic printing machines, such as copiers and printers, as well as other printing machines, sheet transports are employed to transport sheet materials, generally known as copy sheets, to and from a processing station to impart or imprint an image to or on the copy sheets. For example, in electrophotographic printing machines, sheet transports transport or carry sheet material through a transfer station where a developed image is transferred to the sheet material.

Copy sheet transports of the type to which this invention relates transport a variety of sheet material (e.g., paper, Mylar, and the like) from an input area, which generally is a tray or bin in which a stack of sheets are located, along a defined path. The path generally includes processing stations for imprinting and fixing an image on the transported sheets and apparatus for directing the image bearing sheet toward a sheet output station. Copy sheet transports used with electrophotographic printing machines which print plural discrete images on one copy sheet frequently are provided with a recirculating mode whereby copy sheets are fed from a tray and passed to a transfer station and a fusing station and then, in sequence, to a buffer or holding tray for subsequent recirculation to the transfer station for duplex printing.

Other printing machines, which print multiple discrete images on individual copy sheets, have a recirculation path for such operation so that copy sheets after imaging move along the path to return to the imaging station without a holding tray. Still other printing machines provide a composite image which is formed by plural passages of the imaging surface so that plural images are formed on the imaging surface and transferred to the copy sheet. Many sheet transports also invert the copy sheets prior to return to the transfer station so that the recirculated copy sheets may be imaged on both sides (i.e., duplexing). In any event, the prime function of sheet transports of the type to which this invention relates is to transport copy sheets from a stack along a path through a transfer station and, at the fusing station, and onto an output or finishing station in a predetermined collated order.

In general, printing machines are of two types, precollation and post-collation. Precollation devices generally include a printing machine which produces copy sheet sets seriatum until the desired sets "N" are made. The Docutech model printing system available from Xerox Corporation and other machines similarly operating use essentially a hybrid precollation method of producing concurrently two streams of collated sheets intermixed which are separated prior to two stacking trays by an alternatively positionable gate. These machines operate in contradistinction to post-collation-type devices where sheets are output page $1-1_n$, $2-2_n$, etc. where "N" is the number of sets desired or the sorter capacity of the device. The present invention, while employable with both precollation and post-collation devices, is particularly useful in the precollation and hybrid precollation devices.

The devices with which copy sheet transports are most frequently associated are often given tasks or jobs (e.g., to image a series of copy sheets) which require transport of copy sheets. Often in performing such jobs on one type of printing machine which employs plural cycling of the printed copy sheets, some of the copy sheets transported require less cycles than are required for other copy sheets being printed (e.g., a black and white copy sheet in a two pass highlight color printer needs only one pass compared to copy sheets printed in black and highlight color. Likewise, a simplex copy sheet, a copy sheet printed on one side, needs only one pass compared to the duplex copy sheet, and so on). Thus, when printing sheets requiring multiple passes and sheets requiring fewer passes, present copy sheet transports cycle all sheets through the machine unless other arrangements are made, such as, for example, running the jobs separately and then manually collating the separate jobs A similar problem also arises in printing machines in which the imaging surface is cycled a plurality of times to create a composite image, generally an image composed of several images such a color images, for transfer. In this case, jobs can contain certain composite images which require fewer cycles than other composite images. For example, one image may require only one cycle while a two color image requires two cycles of the imaging surface, so that where a two color image is followed by a black image, pitches can be skipped in copy sheet transports which employ precollation techniques. This, like the aforementioned plural pass printing machines which required cycling of sheets which are not imaged, the cycling of completed images on the imaging surface is wasteful of time and resources. Both types of machines, those which cycle sheets and those which cycle the imaging surface a plurality of times to create a composite image, will be collectively referenced hereinafter as plural cycle printing machines.

To restate this, copy sheet transports used with plural cycle printing machines of the type in which successive images were transferred to the copy sheet often present sheets for printing at the transfer station which are not imaged (e.g., a simplex document contained within a job having duplex documents, a black and white image document in a job having multi-color images). Also, copy sheet transports used with plural cycle printing machines of the type in which a composite image is formed on a surface and then transferred to a copy sheet, often skip pitches when jobs contain composite images requiring different numbers of cycles. Needless to say, a single such waste is unnoticed, but when many such documents are in the job, it is an inefficient construction, wasting both resources and machine time. The following disclosures may be relevant to various aspects of the present invention:

U.S. Pat. No. 4,949,949 Patentee: Holmes et al. Issued: Aug. 21, 1990

U.S. Pat. No. 5,012,296 Patentee: Dinnissen et al. Issued: Apr. 30, 1991

U.S. patent application Ser. No. 07/955,817 Applicant: Acquaviva Filed: Oct. 2, 1992

U.S. Pat. No. 5,095,342 Applicant: Farrell, et al. Issued: Mar. 10, 1992

These references may be briefly summarized as follows:

U.S. Pat. No. 4,949,949 discloses a document transport for use with a copying machine to permit nonlinear paper sequencing. The document transport has three paths: an input path connecting the input tray with the imaging station, an output path with a selectable document inverter connecting the imaging station with the output tray and a bypass path, which interconnects the input and output paths so that documents after imaging and inversion can be returned to the imaging station immediately after imaging or after only one intervening document. The patent also discloses a similar return path for copy sheets. Thus, a document transport and a copy sheet transport are disclosed which returns previously imaged documents in an inverted manner to an imaging station and copy sheets likewise inverted and having an image formed thereon to the transfer station for printing the inverted document image on to the inverted copy sheets. In the return path only one intervening copy sheet or image pitch separates the first and second image transfer to a copy sheet. The patent discloses making relatively rapid duplex sheets so that long endless loop copy paths and/or buffers are not needed yet also provides relative efficient duplexing.

U.S. Pat. No. 5,012,296 discloses a printing machine for producing duplex copying images essentially having the same type of document handling bypass loop between the inversion portion of the output path and the input path to the imaging station as that of U.S. Pat. No. 4,941,023. The patent further discloses that the copier portion of the device has an increased length of travel in the path between fixing on a first side of a sheet and return of the sheet for transfer to the opposite side so that each document is imaged twice on a side before exiting the imaging station.

Co-pending U.S. application Ser. No. 07/955,817 filed Oct. 2, 1992, discloses a document transport providing for improved job recovery by permitting out of sequence imaging of documents through the provision of a shunt path which retains documents previously imaged and returning such documents for reintegration with other documents at an output station.

U.S. Pat. No. 5,095,342 discloses a printer job scheduling method for scheduling document images. The method provides for imaging sheets on a continuing basis by consecutively inserting sheets to be printed from an endless duplex loop and by inserting sheets to be imaged with the sheets in the duplex loop so as to avoid skipped pitches during printing operations. The imaging system provides electronic images to be ordered so that the sheets are printed with the appropriate image. The method operates without regard to set or job boundaries. In this manner, skipped pitches are avoided.

Thus, there exists a need for a relatively low cost, simple means and method to achieve printing of sheets in plural cycle printing machines. The present invention provides the method and means for accomplishing this task. Specifically, the present invention provides a sheet path buffer tray or loop which receives completed sheets which, if retained, can be later integrated with sheets which required further printing cycles of the sheet or the image surface for completions. Those returned copy sheets or delayed copy sheets and the sheets retained in the buffer tray or loop can then feed together prior for finishing or be cued to the output tray in a predetermined collated sequence.

SUMMARY OF THE INVENTION

Pursuant to one aspect of the present invention, there is provided a copy sheet transport for producing a stream of image bearing copy sheets in a predetermined collated order from a stream of image bearing sheets in a non-collated order. The copy sheet transport comprises means for transporting a stream of individual image bearing copy sheets along a sheet path to an output station. Means are provided for diverting selectively ones of the image bearing copy sheets from the sheet path to a shunt path. Means selectively return the image bearing copy sheets in the shunt path to the sheet path so that the stream of image bearing copy sheets at the output station of the sheet path are in the predetermined collated order.

According to another aspect of the invention, there is provided a method for producing a stream of image bearing copy sheets n a predetermined collated order from a stream of image bearing copy sheets. The method comprises the steps of transporting a stream of individual image bearing copy sheets along a sheet path toward an output station and diverting selected ones of the image bearing copy sheets from the sheet path into a shunt path. The selected ones of the sheets are returned to the sheet path from the shunt path so that the stream of image bearing copy sheets are in the predetermined collated order.

According to yet another aspect of the present invention there is provided a plural cycle printing machine of the type having a transfer station for transferring images to sheets and producing a stream of imaged sheets in a predetermined order. The printing machine comprises means for transporting sheets to and from the transfer station for receiving images. Means are provided for reorienting the position of the imaged sheets transported by the transporting means from the transfer station so as to produce a stream of imaged sheets in the predetermined order.

Thus, the present invention provides a relatively simple, inexpensive and effective means for reducing waste and increasing efficiency in copy sheet transports used with printing machines requiring multiple pass imaging of certain copy sheets of a printing job. Further, the invention provides a secondary or alternative path to delay delivery of unselected copy sheets to the output bin in jobs having both copy sheets requiring multiple cycles and ones requiring fewer cycles.

BRIEF DESCRIPTION OF DRAWINGS

Other aspects of the present invention will become apparent as the following description proceeds and upon reference to the drawings, in which.

Figure 1:
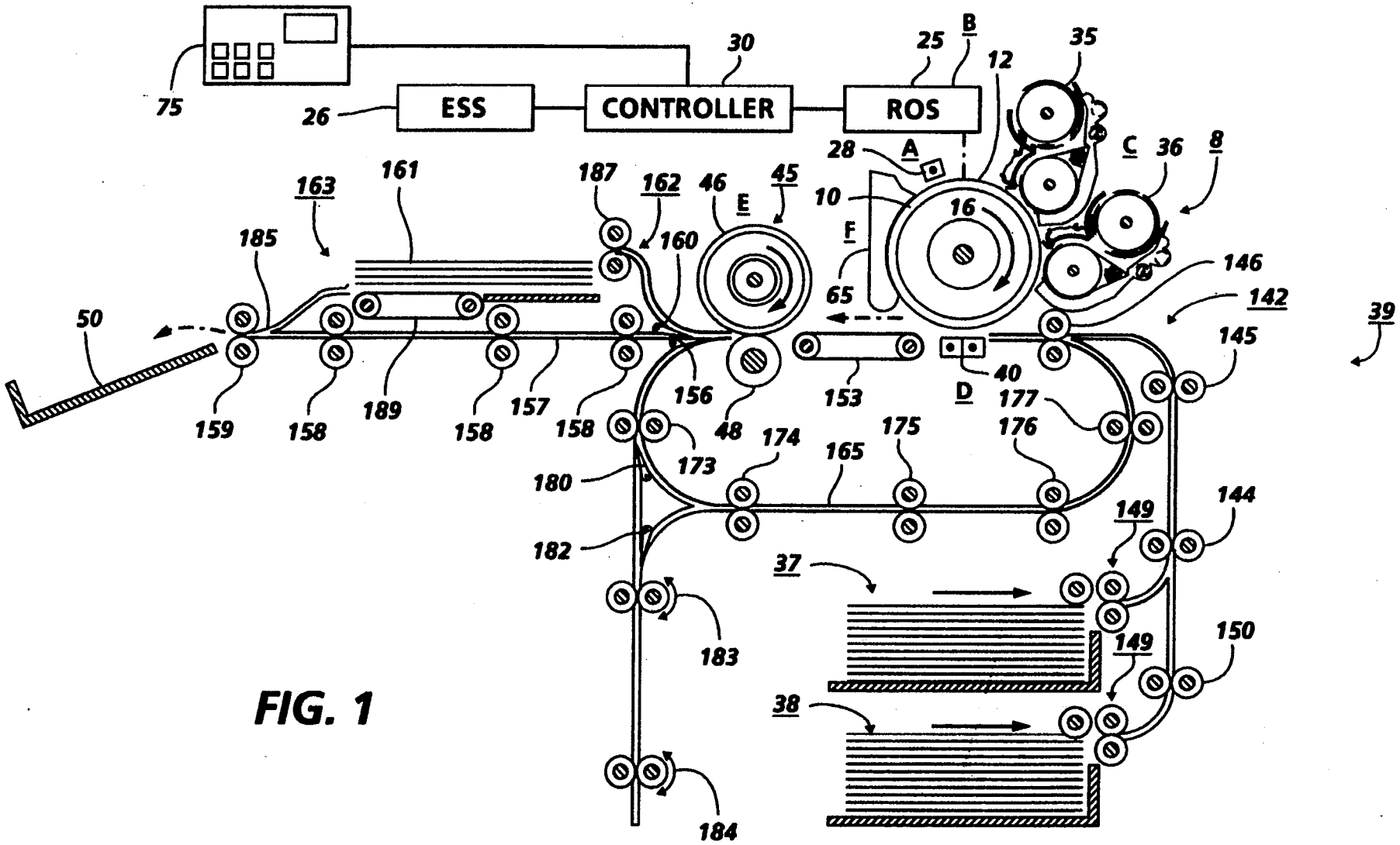
FIG. 1 is a schematic elevational view depicting an illustrative electrophotographic printing machine incorporating a sheet transport system showing one embodiment of the present invention.

While the present invention will be described in connection with the preferred embodiment thereof, it will be understood that it is not intended to limit the invention to that embodiment. On the contrary, it is intended to cover all embodiments, modifications, and equivalents as may be included within the spirit and scope of the invention as defined by the appended claims. For a general understanding of the features of the present invention, references should be made to the drawings. In the drawings, like numerals have been used to identify identical elements.

DETAILED DESCRIPTION

FIG. 1 schematically depicts an electrophotographic printing machine 8 incorporating one embodiment of a sheet transport embodying the features of the present invention therein. Specifically, the illustrative electrophotographic printing machine 8 includes a photoreceptor drum 10 and processing stations acting thereon: charging station A, exposing station B, developing stations C, transferring station D, fusing station E, and cleaning station F. It will be understood that a finishing station such as stacking trays thereof and/or a stapling apparatus or other known finishing station apparatus such as a binding device could be incorporated in the illustrative electrophotographic printing machine 8 subsequent to the fusing station E thereof. Drum 10 with a photoconductive surface 12 therein is rotationally actuated by a motor (not shown) through known transmission such as a belt. The drum 10 thus moves in the direction of arrow 16 to advance successive portions of the photoconductive surface 12 sequentially through the various processing stations disposed about the path of movement of this illustrative electrophotographic printing machine. Thus, a portion of the photoconductive surface 12 passes through a charging station A. At charging station A, the portion of photoconductive surface 12 proximate the station is charged to a substantially uniform potential. As shown in this illustrative printing machine, station A comprises a corona generating device 28 which charges the surface to a relatively high potential.

As the drum 10 advances, the charged portion then passes to an exposing station B. At exposing station B, a latent image is formed on the photoconductive surface via raster output scanner 25 (ROS) which, receives an electronic signal from an electronic signal source (ESS) 26, such as a computer interface which is directed through a controller 30. It will also be understood that for a copier, a raster input scanner (RIS) can be used in conjunction with the ROS 25 and ESS 26, or a light lens system can be used instead of a RIS, ROS and ESS. In the exemplary printing machine, the exposing station B exposes the photoconductive surface 12 to form a latent image thereon.

The portion of the photoconductive surface 12 bearing the latent image then advances to the development station C. At development station C, development of the latent image occurs with the application of toner material to the surface. In this case, either magnetic brush developer unit 35 or magnetic brush developer unit 36 delivers the developer material proximate to the latent image. It will be understood that the present machine is intended to represent a plural cycle highlight color printing machine of the type which forms and transfers two powder toner images separately to form a composite image on a substrate. The powder toner material electrostatically adheres to the imaged areas to form the developed image on the photoconductive surface 12. The developed toner image advances to the transfer station D, as the drum 10 continues to rotate in the direction of arrow 16. At transfer station D, the toner image on the drum 10 contacts a copy sheet supplied from copy input tray 37 or 38 by copy sheet handling system 39, which includes sheet feeders and driven roll sets for driving sheets to the transfer station D, as will be more fully described below. It will be understood that appropriate registration means may be employed in the sheet handling system 39, such as, for example cross-rolls. Corona generators 40 generate a charge as a copy sheet is passing through the transferring station D so that a developed toner image on the drum 10 is attracted and transferred to such copy sheet. After the developed toner image is transferred to the copy sheet, the copy sheet handling system 39 advances the copy sheet with the transferred toner image thereon to the fusing station E.

The fusing station E includes a fuser assembly, generally indicated by reference number 45 which affixes the transferred toner image to the copy sheet. The fuser assembly 45, as depicted, includes a heated fuser roller 46 and a pressure roller 48 which permanently bonds the toner image to the copy sheet. The sheet handling system 39 after directing sheets through the fusing station E, eventually directs such sheets to an output tray 50, as will be described hereinafter in more detail.

The portion of the photoconductive surface 12, after passing the transfer station E where the developed toner image was transferred, advances to a cleaning station F. The cleaning station F removes residual toner particles and other such material remaining on the photoconductive surface 12. As shown cleaning station F includes a cleaning unit 65 which has a knife edge (not shown) therein which contacts the photoconductive surface 12 to clean it. A discharge corona generating device (not shown) can be placed proximate the unit 65 to dissipate residual charges remaining on the photoconductive surface to prepare it for the next successive imaging cycle beginning with station A, the charging station.

The entire sheet transport system 39 is mounted in the printing machine 8 so as to be accessible by the operator. Moving or sliding covers (not shown) are provided to permit manual replacement of copy sheets as well as convenient clearance of jams occurring in the sheet transport system. The sheet transport system 39 has additional covers (not shown) or shields to cover certain moving, heated, electrified, and/or other fragile parts for safety and efficiency reasons.

Continuing to reference FIG. 1, the features of the present invention will now be described in greater detail. The machine functions described and other machine functions to be described or as may be useful are regulated by a controller 30. The controller is preferably a programmable microprocessor which controls all necessary machine functions described herein. Control of all exemplary systems described may be accomplished via conventional control switches input from the printing machine console 75, as selected by the operator, and automatically by the controller 30 in response to input signals from the console 75 and various known types of sensors distributed throughout the printing machine 8. For example, copy sheet path sensors and/or switches may be utilized to providing tracking signals to generate positional information regarding the position of copy sheets moving in their respective paths and also to recognize jams and other problems requiring extraordinary measures. In addition, controller 30 regulates the various positions of gates within the system to be described in further detail hereinafter.

As shown in FIG. 1, the copy sheet transport system 39 for transporting copy sheets successively to and from an image processing station provides efficient and automatic means for improving the effectiveness and efficiency of copy sheet handling in plural cycle printing machines by eliminating or reducing missed pitches in jobs consisting of copy sheets requiring different numbers of cycles for printing within the same job. As will become evident from the following discussion, the copy sheet handling apparatus of the present invention may be employed in and with a wide variety of systems and is not specifically limited in its application to the particular embodiments depicted herein.

In the copy sheet transport system 39 of FIG. 1, there are input stacking trays 37 and 38 into which sheets for transport may be stacked. The sheet handling system 39 provides for automatic transport of successive registered sheets through conventional image processing stations such as transfer station D, and fusing station E of the illustrative electrophotographic printing machine depicted herein. The copy sheet path 142 of the copy sheet handler system 39 employs roller sets and air plenums to transport sheets along the path. In this embodiment, copy sheets are selectively fed one at a time from the top one of the stack of sheets in the copy sheet trays 37 and 38. The copy sheets from each of the stacks 37 and 38 are fed via roller arrangements 149 associated with the respective trays to the sheet path 142 which includes roller sets 144, 145, and 146 which can be cross-roller sets that direct the fed sheet documents for transport to the transfer station D in a registered position. (It will be understood that sheets feed from tray 38 are also directed by roller set 150.)

Copy sheets exit the transferring station D via an air plenum transport 153 to the fusing station E. Copy sheets passing through the fusing station E are directed toward decision gate 156 which, when in the shown first position, directs sheets toward decision gate 160. The decision gate 160, when in the shown first position, directs sheets along a path 157 toward output tray 50 via roller sets 158 and a roll set 159. In some instances, documents passing the gate 156, when in its first position are redirected in the second position to a holding output buffer tray 161 of a shunt path 162 by positioning the decision gate 160 in the second position. The buffer tray 161 is provided with a first-in first-out feeding system 163 (e.g., top loading-bottom feeding). The purpose of the shunt path 162, including decision gate 160 and buffer tray 161, will be more fully explained below.

Copy sheets directed by decision gate 156, when in its second position, pass along the return path 165 toward the transfer station for transfer of an additional image to such transported sheets. As described above, the machine 8 is a two pass highlight color printing machine so that sheets to be printed in two colors and having one color fused thereon by fusing station E need to return to the transfer station D to form the second color image. In this illustrative embodiment along the path 165, there is also a selectable inverter means 170 to permit duplexing. Also, roller sets 173, 174, 175, 176 and 177 provide transport of copy sheets along the path 165. Decision gate 180 selectively directs copy sheets passing roller set 173 to the inverter 170 past gate 182, which can be biased to permit passage to reversibly drive roller sets 183 and 184 but prevent passage of sheets from such roll sets back to roller set 173. Thus, sheet directed by the roller sets 183 and 184 in a reverse direction is guided by the gate 182 in a now inverted fashion to the roller sets 174. As is common practice, each of the roller sets in the above-described system contain a drive roller and at least one idler roller. Further, while registration means such as cross rollers have been discussed herein, it is well known to use other common registration devices to provide registered presentation of the sheets, as appropriate.

The overall function and features of this invention will now be explained in greater detail. In FIG. 1, the shunt path 162 is defined in the copy sheet transport system 39 between the gate 160 and an integrating area 185. Specifically, copy sheets passing the gate 160 may be directed to roller sets 158 or to the buffer tray 161 along the path 162 of which includes a set of rollers 187, which are preferably corrugating rolls. Sheets in the buffer tray 161 may be fed from the buffer tray 161, by the feed system 163 which, in this embodiment, includes a belt feeding mechanism 189 to the integrating area 185 in the path 157. Thus, the buffer tray 161 and associated guide ways and sheet actuators define the shunt path 162 so that sheets selectively directed out of the primary path may be integrated into the primary path. It will be understood that other appropriate feed mechanisms may be used in conjunction with various sheet holding arrangements, for example, sheets may be fed by a shingling, feeder mechanism or other known feeding mechanism.

Table 1 provides an example of the operation and use of the present invention.

TABLE 1

| Rotation#-Pitch# | Yellow Doc.-Image# | Black Doc.-Image# |
|---|---|---|
| 1-1 | | 10-1 |
| 1-2 | 9-1 | |
| 2-1 | | 8-1 |
| 2-2 | | 7-1 |
| 3-1 | 6-1 | |
| 3-2 | | 9-2 |
| 4-1 | | 5-1 |
| 4-2 | 4-1 | |
| 5-1 | | 6-2 |
| 6-2 | 3-1 | |
| 7-1 | | 2-1 |
| 7-2 | | 4-2 |
| 8-1 | | 1-1 |
| 8-2 | | 3-2 |

In the example of Table 1, the illustrative electrophotographic printing machine 8 is of a plural cycle highlight color printing machine of the type which recycles sheets in plural passes, so that return of sheets for printing is expected so as to enable the printing of imaged sheets in two colors. Further, for the purposes of this discussion, the order of printing in this machine is, generally N-1, as is well known. This example demonstrates a job which requires plural cycles of certain sheets and only one cycle for other sheets within the job. That is, the job assigned to the printing device comprises a 10 document run, which includes a number of documents, for example, document images #3, #4, #6, #9 to be printed in two colors by passing sheets for receiving such images (e.g., black, and a highlight color (e.g., yellow)) through the transfer station twice and a number of sheets to be printed in one pass (#1, #2, #5, #7, #8, #10) (e.g., black). In this example, assume that drum 10 has two imaging pitches and a sheet passing along the return path to the transfer station D requires a time equivalent to three pitches or (one and a half rotations of the imaging drum (i.e., three images can be formed before a sheet can return.)

Thus, the first document to be imaged would be document #10 (preferably an electronic document processed so that the ESS 26 directs document image signals to the controller 30 which drives the ROS 25), which requires only a single pass for imaging. The document image would be recorded on the drum 10 in the form of a latent image that is developed by toner from developer housing 35. The sheet handling unit would then direct a sheet through the transfer station D to transfer the developed image to form a printed sheet #10, which is then directed through the fusing station E. After fusing, the sheet #10 is directed through the gates 156 and 160, along path 157 to the output tray 50.

The first image of document #9 would be imaged and developed with the highlight color, yellow, in this example, on the drum pitch following the pitch on which the image of the document #10 was formed. The developed image would then be transferred to form printed sheet #9, which would be directed to the fusing station E. Sheet #9 is then directed to the return path 165, by positioning decision gate 156 in the second position, while respective sheets for printing document images #8, #7 and #6 (first image) would have the corresponding developed images transferred and fused thereto, at which point the second image of document #9 would be imaged on the drum 10 and then transferred to printed sheet #9 having returned to the transfer station D along the return path 165.

Thus, by the time sheet #9 with the first image (e.g., yellow) fused thereon returns to the transfer station printed sheets #8 and #7 having been completely printed are directed through the fuser 45 and decision gate 156. However, decision gate 160 directs the sheets #8 and #7, in the order of imaging, to the shunt path 162 (i.e., to the buffer tray 161 where sheet #7 is on top of sheet #8). Printed sheet #6, meanwhile, is directed to the return path 165 by decision gate 156, in the manner that sheet #9 was directed. Sheet #9, after receiving the second image (e.g., black) at the transfer station again passes through the fusing station so as to fix the second image. The sheet is then directed past decision gates 156 and 160 to the output tray 50 via path 157.

While printed sheet #6 with one image thereon passes along the return path 165, and sheet #9 with two images thereon is directed to tray 50. The document images #5 and the first image of document #4 are processed and transferred to sheets #5 and #4. Additionally, after sheet #9 has passed the integration area, sheet #8 and then sheet #7 are fed in sequence from the buffer tray 161 and directed to the output tray 50. After sheet #4 receives the transferred image, printed sheet #6 returns for the second image, while printed sheet #5 is directed to the buffer tray 161 in substantially the same fashion as printed sheets #8 and #7 and printed sheet #4 is directed to the return path 165, as were printed sheets #9 and #6, previously.

After printed sheet #6 has past the transfer station D for the second time, it is directed to the output tray 50 past decision gates 156 and 160 via path 157. Sheet #5 is then fed from the buffer tray 161 to the output tray 50. Sheet #4, meanwhile, is directed along the return path 165 while document images #3 and #2 are developed and transferred to printed sheet #3 and #2, respectively. Thereafter, the sheets are directed to the fusing station and sheet #2 is directed to the buffer tray 161 by gate 160, while sheet #3 is directed to the return path 165 by gate 156. Printed sheet #4 then receives the second image which is then fused thereon. Sheet #4 is then directed to output tray 50 along path 157. Sheet #1 then receives developed document image #1 and is directed through the fusing station and onto the buffer tray 161. Sheet #3 then returns to the transfer station to receive the second image which is then fused thereon. The sheet #3 is then directed past the integration area 185, and is transported to the output tray 50, printed sheet #2 followed by printed sheet #1 are directed to the output tray 50 from the buffer tray 161.

In this example, of 14 images made, no extra pitches were required. It will be understood that in certain job situations, particularly if the last documents images to be imaged require plural cycles, pitches will be skipped. However, the number of skipped pitches is considerably less than required in a device requiring all sheets to be recirculated. It will be understood that the present invention may be employed generally with any plural cycle color printer, although additional shunt paths may be necessary to accommodate jobs and printing machines having additional color combinations and belt pitches. It will also be understood that the present invention may be employed in a single color printing machine which have a duplexing capability, which is within the definition of a plural cycle printing machine. That is, it would be particularly useful in printing duplex/simplex combination jobs. In such cases, it is preferred that sheets to be duplexed be printed on the duplex side first so as to make collation simpler.

By way of example, such a printing machine could be a device similar to that of FIG. 1, where only one developer housing (for example, 35) is operated (or is provided). Table 2 is provided to illustrate this type of printing machine. That is, assume that sheet F is to be duplexed and sheets E, D, C, B, and A are to be simplex printed in a job of printing N through 1 sheets. In this case, sheet F would be printed, preferably in this embodiment, on the duplex side and directed to the return path and inverted by the inverter 170. It will be appreciated by those skilled in the art that other known inverting and returning structures may be used in accordance with the present invention.

TABLE 2

| Rotation#-Pitch# | Yellow Doc.-Image# | Black Doc.-Image# |
|---|---|---|
| 1-1 | F-2 | |
| 1-2 | | E-1 |
| 2-1 | | D-1 |
| 2-2 | | C-1 |
| 3-1 | | B-1 |
| 3-2 | | F-1 |
| 4-1 | | A-1 |

Assuming that the inverter requires an additional pitch in recirculating sheets than in the previous example (e.g., 4 pitches rather than 3 pitches), and that drum 10 still has 2 pitches. Sheets E, D, C and B would receive images and be directed through the fusing station. Sheet F would then be directed to the transfer station to receive the simplex side image. Sheet F, after fusing, would be directed to the output tray 50, and then sheets E, D, C and B, which were directed to the buffer tray 161 in order of printing, would be fed from the buffer tray to the output tray 50. Thereafter, sheet A with the image fixed thereon, is directed to the output tray 50.

Thus, as should be clear, in the embodiment of FIG. 1, the control signals for the sheet handler and document image operation (in the present case, signals from ESS 26 and signals to ROS 25) are provided by the machine controller 30, which as discussed is a microprocessor system It is contemplated that the controller 30 controls the sequencing of document images, which is well known, see, for example, U.S. Pat. No. 5,095,342, incorporated by reference herein, as well as the operation of sheet handler 39.

Figure 2:
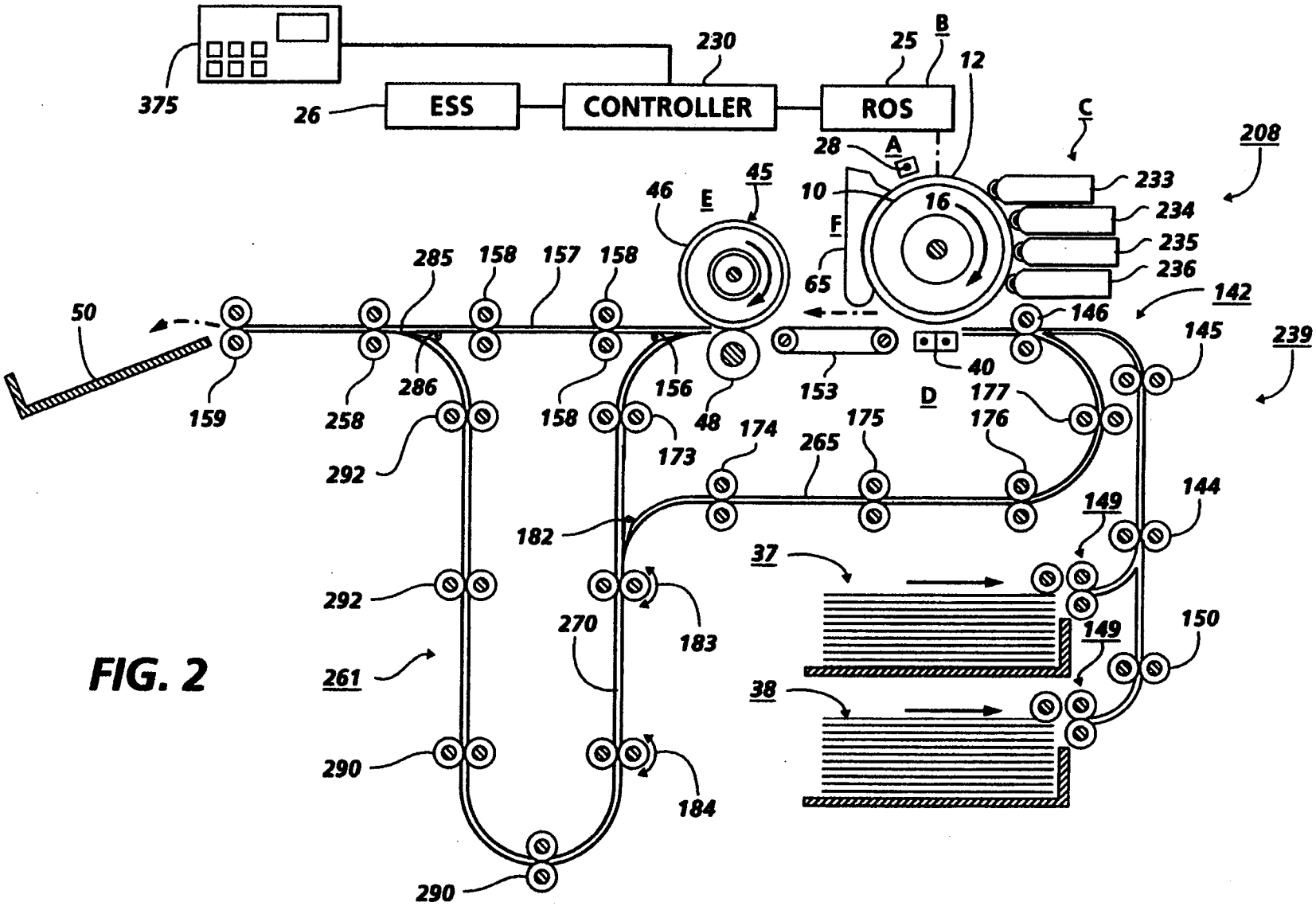
FIG. 2 is a schematic elevational view depicting another illustrative electrophotographic printing machine, similar to that of FIG. 1, incorporating another embodiment of the sheet transport system of the present invention.

Referring now to FIG. 2, another embodiment of the invention is shown therein. Specifically, a plural cycle printing machine 208 similar to that of FIG. 1, except that the device herein is a "REaD" system (Recharge, Expose and Develop successively on a single pitch prior to transfer.). That is, the printing machine 208 operates by forming a composite image by imaging and developing plural images on top of one another on the photoreceptive surface before transferring a composite image to the substrate. The photoreceptive drum 10 has processing stations positioned around it. Specifically, a charging station A, an exposure station B, a development station C, a transfer station D, a fusing station E, and a cleaning station F.

In this embodiment, the photoreceptor drum 10 can be charged to a substantially uniform charge level by the charging station A which in this case is represented by a corona generating device 28. As the drum is rotated in the direction indicated by arrow 16, the charged portion of the drum 10 is acted on by the exposure station B, which in this case is preferable a ROS 25, to discharge the photoconductive surface of the drum to form a latent image. The latent image formed on the surface is then transported to the development station C as the drum rotates. One of developer housings 233, 234, 235, and 236 would be activated so that developer material within the developer housing, for example, the housing 233, would position developer material (yellow toner, in this case) proximate the surface so as to be attracted to portions of the latent image on the surface to thereby develop the image.

If the composite image to be developed is a multiple level color image (e.g., black and yellow; magenta, cyan and yellow, black, cyan, magenta and yellow, etc.) the drum would continue rotating with the image thereon past the transfer station D through the cleaning station F on which neither station acts so that the portion of the surface with the image would again be charged to a high level of charge by the charging station A. Specifically, for this example, it will be assumed that all four colors will be developed so that the drum 10 would continue to the exposure station B where again portions of the surface would be discharged to record a second latent image on the original photoreceptor. In this case, the second developer housing 234 would be activated to develop the second latent image (cyan toner in this case), while the other developer housings 233, 235 and 236 would be inactivated. In this instance, developer materials from the developer housing 234 would be brought close or proximate the surface and would be attracted to the portions of the drum 10 to form a composite image of both cyan and yellow toner. Likewise, this would be repeated for the other developer housings 235 and 236, respectively, until a four color composite image was formed.

Thus, in this example after a composite image has been formed, a sheet from either stack trays 37 or 38 by the sheet handling unit 239 would be brought to the transfer station D. The corona generating device 40 positioned on one side of the sheet attracts the developed composite image from the photoreceptive drum surface to the sheet. The sheet is then transported from the transfer station D with the developed image on it to a fusing station E for fixing the image to the sheet. In this case, the fusing station E is represented by fuser assembly 45 having the heated roller 46 and the pressure roller 48.

The sheet is then transported through the remainder of the sheet handling unit 239 in an appropriate preselected manner as will be described in detail below. The surface of the drum after having transferred a developed composite image to a sheet then passes to the cleaning station F which then acts to remove any remaining toner on the drum and other extraneous materials and charges. The drum then again passes to the charging station for another image cycle.

Further, the controller 230 is substantially the same as the controller 30 of FIG. 1, so that it controls and tracks the position of the sheets except that the operating signals are different to provide for functions consonant with the differences discussed below and the like. The controller 230 also conventionally operates and changes displays on a connecting instructional display panel 375 which preferably includes operator selection buttons or switches to enable an operator to select functions and override controller selections, as appropriate.

With continued reference to FIG. 2, the copy sheet path 239 comprises many of the same components of FIG. 1, which have been numbered identically, and these will not be discussed again except as they effect other components and the illustrative example of the operation of this embodiment given below. In this instance, the return path 265 of the sheet handling unit 239 is only employed in instances requiring a duplex copy. That is, a sheet is directed to the path 265 only for two sided copies as composite images are formed on the drum 10 prior to transfer. The inverter 270, includes reversible, driven roll sets 183, 184 and bias gate 182, which cooperate to invert selected sheets and direct them to the roll set 174 to permit transport along the path 265, and, thus, enabling duplex printing.

In this embodiment, a shunt path is defined as a loop path 261 comprising the actuable decision gate 156 for selectively directing sheets to the loop path 261 which has multiple sets of rolls 173, 183, 184, 290, and 292. In this case, one or more sets of rolls can be spaced so that sheets may be retained thereby for periods of time. At the integration area 285, a gravity operated gate 286 is positioned at the exit of the path 261 so that sheets moving from the loop path 261 back to the primary path 157 urge the gate 286 to open. Such sheets passing through gate 286 from the loop path 261 at the integration area 285 are engaged by the roller set 258 and then directed to the output tray 50 by roller set 159.

As with the illustrative embodiment of FIG. 1, it is believed that an example will facilitate an understanding and appreciation of the present invention embodied in the illustrative electrophotographic printer of FIG. 2. Documents images (e.g., #12-#1) are to be printed with the image of documents #12, #8, #7, #5, #4 and #3 requiring plural color images to form a composite image corresponding to the document image, it will be understood that in this instance some of the document images do not require all colors to make the composite image. That is, while document images #12, #5 and #3 require all four colors of the illustrative printing machine, document image #8 requires only three colors, and document images #7 and #4 require only two colors. Thus, document images #11, #10, #9, #6, #2, and #1 require only one color. Table 3, graphically presents the ordering of printing of the document images in the illustrative electrophotographic printing machine which in this embodiment is assumed to have two imaging pitches per rotation of the drum.

TABLE 3

| Rotation# -Pitch# | Yellow Doc.-Image# | Cyan Doc.-Image# | Magenta Doc.-Image# | Black Doc.-Image# |
|---|---|---|---|---|
| 1-1 | 12-1 | | | |
| 1-2 | | | | 11-1 |
| 2-1 | | 12-2 | | |
| 2-2 | | | | 10-1 |
| 3-1 | | | 12-3 | |
| 3-2 | | | | 9-1 |
| 4-1 | | | | 12-4 |
| 4-2 | 8-1 | | | |
| 5-1 | 7-1 | | | |
| 5-2 | | | 8-2 | |
| 6-1 | | | | 7-2 |
| 6-2 | | | | 8-3 |
| 7-1 | | | | 6-1 |
| 7-2 | 5-1 | | | |
| 8-1 | | 4-1 | | |
| 8-2 | | 5-2 | | |
| 9-1 | | | | 4-2 |
| 9-2 | | | 5-3 | |
| 10-1 | 3-1 | | | |
| 10-2 | | | | 5-4 |
| 11-1 | | 3-2 | | |
| 11-2 | | | | 2-1 |
| 12-1 | | | 3-3 | |
| 12-2 | | | | 1-1 |
| 13-1 | | | | 3-4 |

To further explain Table 3, after the printing machine of FIG. 2 is ready to begin the exemplary printing job of documents 1–12 (e.g., warm-up routines, error checking, etc.) the controller would submit an electronic image corresponding to the first color image of document #12 to be exposed and developed on the first pitch of drum 10 during the first rotation. Likewise, the second pitch of the first rotation would be exposed and developed with the first color of document image #11. Since the desired composite document image #11 is a single color, the developed image on the second pitch would then be transferred to a copy sheet to form copy sheet #11. Copy sheet #11 would then be directed to the fusing station E to affix the image to the sheet. Copy sheet #11 would then be directed by decision gate 156 into loop path 261 toward gravity gate 286 via rollers 173, 183, 184, 290 and 292, to be held by roller sets 292 for later movement.

After the completion of the first rotation of the drum 10, the first pitch of the drum 10 with the first color image of document 12 thereon would be recharged, exposed to form the second color image document #12, and developed with the second color. Meanwhile, the second pitch of the drum on the second rotation through the station would be exposed with the first color of document image #10 and developed with the appropriate color (e.g., black in this example). The developed image would then be transferred to copy sheet #10, which would be handled similarly to copy sheet #11. That is, copy sheet #10 with the developed image would be fused at the fusing station E, directed to the loop path 261 via the decision gate 156, and transported in the path by rollers 173, 183, 184 and 290. Copy sheet #10 would be held by the roller sets 290 for later movement.

During the third rotation of the drum 10, the first pitch with the developed two color images of document #12 would be recharged and then exposed and then developed with the third color image of document #12. The second pitch, after cleaning, would be charged, exposed with the first color image of document #9, developed, and then transferred to copy sheet #9 at the transfer station. Copy sheet #9 with the image thereon would then be fused at the fuser station and directed by the decision gate 156 to the loop path 261 by rollers 173, 183 and 184. The rollers 183 and 184 would maintain the copy sheet #9 for later movement.

During the fourth rotation of the drum the first pitch with the developed three color image of document #12 thereon would be recharged, exposed with the fourth image, developed with the fourth color and transferred to copy sheet #12. The copy sheet #12 would be fused and directed by the decision gate 156 along path 157 via roller sets 158, 258, and 159 to output tray 50. The second pitch after passing the cleaning station F would be charged, exposed to form the first color image of document #8, developed with the appropriate color (e.g., yellow in this instance). Meanwhile, copy sheets #11, #10 and #9, respectively, after copy sheet #12 passed the integration area 285 would be moved from the loop path 261 back to the primary copy sheet path 157 by actuating the appropriate roller sets 292, 290, and 184 and 183 so that the copy sheets #11, #10 and #9 would pass through gravity gate 286 at the integration area 285 to be then moved by roller sets 258 and 159 to the output tray 50. Thus, the copy sheets with output tray would be arranged in a face-up, consecutive collated fashion from copy sheet #9 to copy sheet #12.

The first pitch after being cleaned at the cleaning station (e.g., the first cleaning of this pitch in this example since the commencement of imaging of document #12), is charged, during the fifth rotation, exposed and developed to form the first color developed image of document #7, and the second pitch is recharged, exposed, and developed to form the second color image of document #8 on the first developed color image of document #8. During the sixth rotation, the first pitch is recharged, exposed and developed to form the completed composite image of document #7, which is then transferred to the copy sheet #7. The image is fused to the copy sheet #7 at the fusing station E, and the copy sheet #7 is directed to the loop path by decision gate 156, as was copy sheet #11. The second pitch is recharged, exposed, and developed to form the final color of the composite image of document #8 which is then fused at the fusing station E. After fusing, the copy sheet #8 is directed, as copy sheet #12, directly to the output station. After the copy sheet #8 has passed the integration area 285, the copy sheet #7 would be transported from the loop 261 in a manner similar to sheet #11.

During the seventh rotation, the first pitch, after being cleaned at the cleaning station F, would be charged, exposed, developed to form the first color of the image of document #6, which in this case would then be immediately transferred to copy sheet #6 at the transfer station. The copy sheet #6 would then be directed by decision gate 156, alternatively as was copy sheet #12 or copy sheet #11. The actual choice will depend upon the timing of sheets in the paths so that sheet #6 may be required to be directed along the loop path 261, to permit the feeding of sheet #7 back into the path 157, rather than feeding sheet #6 directly to the output tray 50 along path 157. In this example, if sheet #6 is required to be fed along the path 261, it could be a continuous feeding through the loop, as the image of document #5 requires several exposures. In any event, after cleaning, the second pitch of drum 10, it is printed with first color of the image of document #5 in the seventh rotation.

In the eight rotation, the first pitch, after cleaning is charged, exposed and developed with the first image of the document #4 and the second pitch is recharged, exposed and developed to form a two color image of document #5. In the ninth rotation, the first pitch is recharged, exposed and developed with the second color of document #4 so that a composite image of the document #4 is formed and transferred to copy sheet #4. Copy sheet #4 with the image thereon is fused and transported as sheet #11. The second the pitch is also recharged, exposed and developed to form a third color image on the previous two color composite image of document #5. In the tenth rotation, the drum is charged, exposed and developed to form the first image of the document #3. The second pitch is recharged, exposed and developed to form the four color composite image of document #5 which is then transferred to copy sheet #5. Copy sheet #5 is transported through the fuser station E and to output tray 50, in like manner to copy sheet #12.

After copy sheet #5 has past the integration area 285, copy sheet #4 would then be transported from the loop 261 in like manner to copy sheet #11 after copy sheet #12 passed the integration area, so that the copy sheets in the output tray are arranged in face-up order to form copy sheets #4 through #12. In the eleventh rotation of the drum, the first pitch would be charged, exposed and developed with the second color of the document #3, and the second pitch, after cleaning, would be charged, exposed and developed to form the first color of the image of document #2 which would be transferred to copy sheet #2. Copy sheet #2 would then be fused at the fusing station and then transported to the loop 261 in substantially the same manner as copy sheet 11.

On the twelfth rotation of the drum 10, the first pitch would be recharged, exposed and developed to form the third color image of the document #3, and the second pitch would, after cleaning, be charged, exposed and developed to form the first color image of the document #1, which would be transferred and fixed to copy sheet #1. After exiting the fuser station, the copy sheet #1 would be directed by the decision gate 156 to the loop path 261 for handling substantially identical to copy sheet #10. On the thirteenth rotation, the drum 10 of the first pitch would be recharged, exposed and developed to form the fourth color image of the document #3. This composite developed image is transferred and fused on copy sheet #3. Copy sheet #3, after fusing would be handled as copy sheet #12 and directed to output tray 50. After passing the integration area 285, the copy sheets #2 and #1 would be directed, as were the copy sheets #11 and 10, respectively, from the loop path 261 to the output tray so that the copy sheets would be arranged as copy sheet #1 through copy sheet #12 in a collated order despite a non-sequential ordering at the transfer station (e.g., in the foregoing example, copy sheet presentation at the fuser was in order sheets #11, #10, #9, #12, #7, #8, #6, #4, #5, #2, #1, #3).

It will be understood that this example represents the case of 15 possible color combinations on the sheets (e.g., cyan, magenta, and black; yellow; yellow and black; black, magenta; magenta and cyan, etc.) and two drum pitches. The present embodiment is particularly applicable to printing machines having any number of color combinations which employ two pitches in jobs using two or more of such color combinations. Likewise, it is also applicable to machines having any number of pitches so long as the machine is limited to printing two color combinations (e.g., cyan, magenta, yellow and black images and black images; or cyan and magenta images and black, magenta and cyan images; or yellow images and black images). However, it will also be recognized that the present invention is also adapted for use with a printing machine which has a multiple pitch imaging surface (i.e., more than 3) to produce multiple color combination, composite images (i.e., more than 3) within a single job. In such case, several bypass or shunt paths of the type disclosed herein can be employed. It will also be understood that such shunt paths could be nested one within another to achieve the necessary function.

In recapitulation, a sheet transport system suitable for use with printers, copiers and other devices having image processing apparatus for imaging sheets has been disclosed. The sheet transport system has a primary path through which sheets are transported to and from a processing station. A secondary or shunt path with entry and exit ports in the primary path is provided. Thus, in cases where certain sheets in a batch of sheets are to be transported to and from a transfer station, a selectable shunt path auxiliary or buffer path can be opened so selected image bearing sheets after passing the transfer station can be accumulated for selective insertion into the imaged sheet stream to form a predetermined collated stream of sheets for output or other processing or alternatively sheets which are imaged with an image in an out-of-sequence order from a predetermined order, are directed to the shunt path for later reintegration in the sheet stream to form a sheet stream in the predetermined collated order.

It is, therefore, apparent that there has been provided in accordance with the present invention, a sheet transport system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A sheet handler for transporting sheets to and from multipass electrophotographic image processing stations comprising:

a sheet input port;

a sheet output port;

a primary sheet path which includes a transfer station for transfer of developer materials to the sheets and a fuser station for bonding the developer material to the sheets and which extends between said input port and said output port;

sheet drivers for transporting sheets in said path from said input port through the transfer station and the fuser station;

a return path connecting a portion of said primary path after the fuser station with a portion of the primary path before the transfer station, a first decision gate to divert selected sheets to said return path for retransport to the transfer station and fuser station;

a shunt path positioned proximate to said output port;

a second decision gate to divert selected other sheets to said shunt path; and a sheet actuator to return the selected other sheets in said shunt path to said primary sheet path so that the sheets passing to said output port are in a predetermined sequence.

2. The sheet handler of claim 1, further comprising a buffer tray, associated with said shunt path, for receiving the selected other sheets, said sheet drivers transporting the selected other sheets from said buffer tray to said primary sheet path.

* * * * *